US005582402A

United States Patent [19]

Gilford

[11] Patent Number: 5,582,402

[45] Date of Patent: Dec. 10, 1996

[54] BASKETBALL SHOT TRAINING DEVICE WITH SIMULATED BALL ROTATION

[76] Inventor: Luther G. Gilford, 27201 Rensselaer, Oak Park, Mich. 48237

[21] Appl. No.: 421,838

[22] Filed: Apr. 13, 1995

[51] Int. Cl.[6] ..... A63B 21/055; A63B 23/14; A63B 69/00

[52] U.S. Cl. ..... 273/1.5 A; 482/46; 482/124

[58] Field of Search ..... 273/1.5 A; 482/44–49, 482/121, 122, 124, 127

[56] References Cited

U.S. PATENT DOCUMENTS 4,310,154 1/1982 Kauffman .
4,383,685 5/1983 Bishop .
4,589,655 5/1986 Ammon ..... 482/46
4,623,148 11/1986 Juhl .
4,709,916 12/1987 Clark .
4,807,609 2/1989 Meals .
4,875,677 10/1989 Tetreault .
4,993,707 2/1991 Schwartz .
5,135,217 8/1992 Swain .
5,271,617 12/1993 Gilford .

*Primary Examiner*—Paul E. Shapiro
*Attorney, Agent, or Firm*—John R. Benefiel

[57] ABSTRACT

A basketball shot training device is described for improving the shooting skills of the user including an elongated member adapted to be strapped to the user's forearm and a hemispherical finger and hand engagement element configured as a portion of a basketball facing the elongate member so as to be engagable with the user's fingers and hand. A resistance member pivotally mounts the hemispherical engagement element to resist movement from a retracted position to an extended position by flexing the hand, fingers and wrist against the resistance in a manner closely simulating the execution of a basketball shot. As the resistance member is being actuated, the hemispherical engagement element is also partially rotated against a resistive force so as to more accurately simulate a basketball shot.

23 Claims, 3 Drawing Sheets

FIG-5
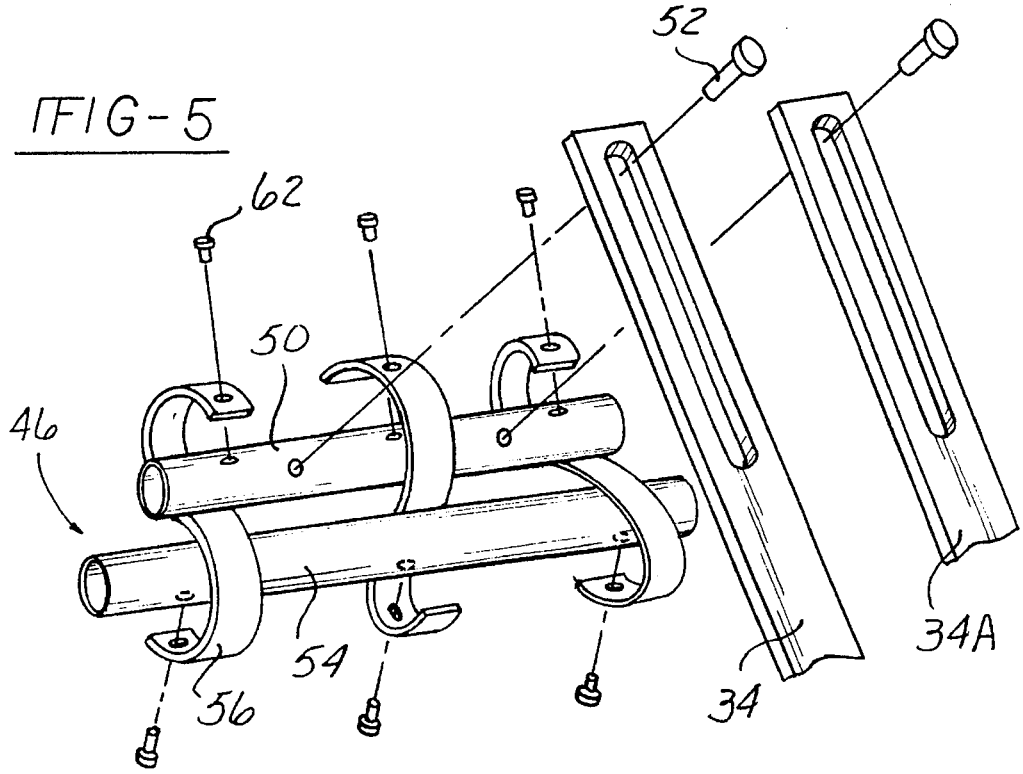
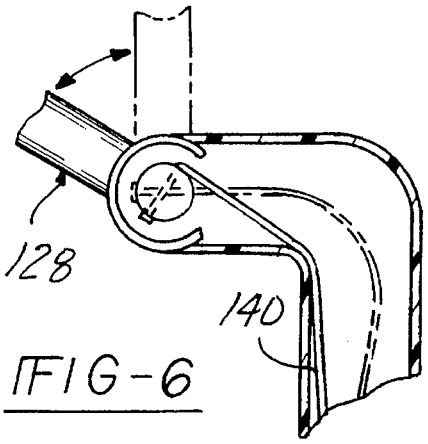
FIG-6
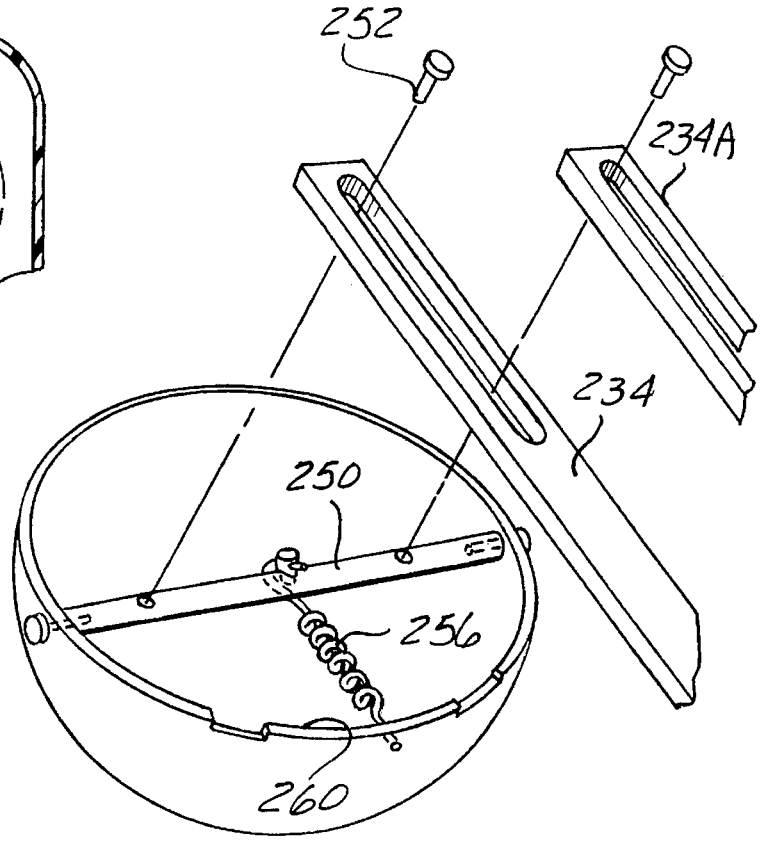
FIG-7

BASKETBALL SHOT TRAINING DEVICE WITH SIMULATED BALL ROTATION

BACKGROUND OF THE INVENTION

The present invention relates to improved training and exercising devices used as aids in increasing the shooting skill of a basketball player. To enhance one's shooting skills, sessions on the basketball court practicing the various shots, combined with general exercise, conditioning, and strengthening programs have traditionally been required.

It is now commonly recognized that the execution of a physical skill is enhanced by the strengthening of the muscle groups involved. In recognition of this fact, exercising devices specifically directed to the development of hand and wrist muscle groups have been devised. However, most of these prior devices have not sufficiently simulated the basketball shot motion to be effective, particularly with regard to the hand and finger muscles.

In an effort to more appropriately simulate the basketball shot motion, the inventor previously developed the shot training device disclosed in U.S. Pat. No. 5,271.617 entitled "Basketball Shot Training Device With Resilient Resistance" which issued on Dec. 21, 1993. While the basketball shot training device disclosed therein is considered to be a significant advancement over other shot training devices in that it serves to strengthen the muscle groups generally associated with the basketball shot, it too, falls short of fully simulating an ideal basketball shot wherein a certain amount of rotational backspin is generated upon the basketball as it leaves the hand during an actual shot.

Additionally, resistance of the device disclosed in U.S. Pat. No. 5,271,617 is effectuated by a rather bulky elastic band attached to the exterior of the frame and across tubular side members. This is considered to be somewhat undesirable in that the elastic band is excessively long and is fully exposed outside of the frame which makes is subject to unnecessary wear and tear.

Therefore, it is an object of the present invention to provide a basketball shot training and exercising device which in use more closely simulates the shot motion including the desirable rotational motion of the basketball as it is being released, such as to develop the precise muscle groups in the fingers, hand, wrist and arm necessary to execute the basketball shot, thereby resulting in the development of those muscle groups and ultimately, improved basketball shooting skills.

It is a further object to provide a basketball shot training device which in use closely approximates the execution of the shot motion such that its use also contributes to the physical learning process otherwise known as "muscle memory."

Still, another object of the present invention is to provide a readily transportable, lightweight basketball shot training device which generally reduces the number of working components required by other known shot training devices.

Yet, another object of the present invention is to provide a basketball shot training device with adjustable tensioning of the resistance member.

Another object of the present invention is to reduce the length and/or bulk of the elastic band required for resistance.

Still, another object of the present invention is to provide a basketball shot training device which contains the elastic bands internally so as to conceal their presence.

SUMMARY OF THE INVENTION

These and other objects of the present invention are achieved by a basketball shot training device comprising an elongate frame member adapted to be strapped or otherwise secured to the forearm of the user, which preferably is adjustably mounted to be fit to the size of the individual user. A resistance member is pivotally mounted along a first end of the elongate frame member so as to be able to be swung towards and away from the side of the elongate member against which the user's forearm is secured. A resilient member is also provided which resists the swinging motion of the resistance member on its pivotal mount. Extending from the free end of the resistance member is a rotational assembly to which a hand and finger engagement element is attached, said hand and finger engagement element defining a generally spherical surface facing the shooting hand of the user which at least approximates the external contour of a basketball. The rotational assembly allows the hand and finger engagement element to be partially rotated against resistance while the resistance member is being actuated.

To use the basketball shot training device of the present invention, the elongate frame member is strapped to the user's forearm, with the hand bent at the wrist to engage the engagement element with the fingers and palm of the hand. The user flexes his wrist so as to push against the engagement surface, causing resistive movement thereof forward and downward, accompanied by a partial rotation of the engagement element, exerting a strengthening effort with the wrist and fingers to closely approximate the shooting motion. The resistance requires a substantial force to be overcome in order to actuate the resistance member from a retracted to an extended position.

This motion when repeated many times develops the precise muscle groups involved in executing the basketball shot, and at the same time in approximating the motion involved in making a shot, contributes to the physical learning process. The device allows the user to strengthen these muscle groups by a peak effort in excess of the effort required by an actual shot.

The device also allows for convenient repetition of the motion in a relatively short period and without the need to actually be present on a basketball court.

The device tends to keep the elbow and forearm substantially vertically aligned during execution of the shot motion, training the user to hold the elbow and forearm in substantially vertical alignment during an actual shot. Thus, the device is also an aid in developing proper form.

BRIEF DESCRIPTION OF THE DRAWINGS

FIG. 5 is a blown apart perspective view of the rotational assembly;

FIG. 6 is a cut away partial sectional side view of the basketball shot training device of FIG. 4, depicting the resistance member being rotated; and FIG. 7 is a blown apart perspective view of an alternative rotational assembly.

DETAILED DESCRIPTION OF THE PREFERRED EMBODIMENTS

In the following detailed description certain specific, particular embodiments are described in accordance with the requirements of 35 U.S.C. 112. However, it should be understood that the same is not intended to be limiting and should not be so construed inasmuch as the invention is capable of taking many forms within the scope of the appended claims.

Figure 1:
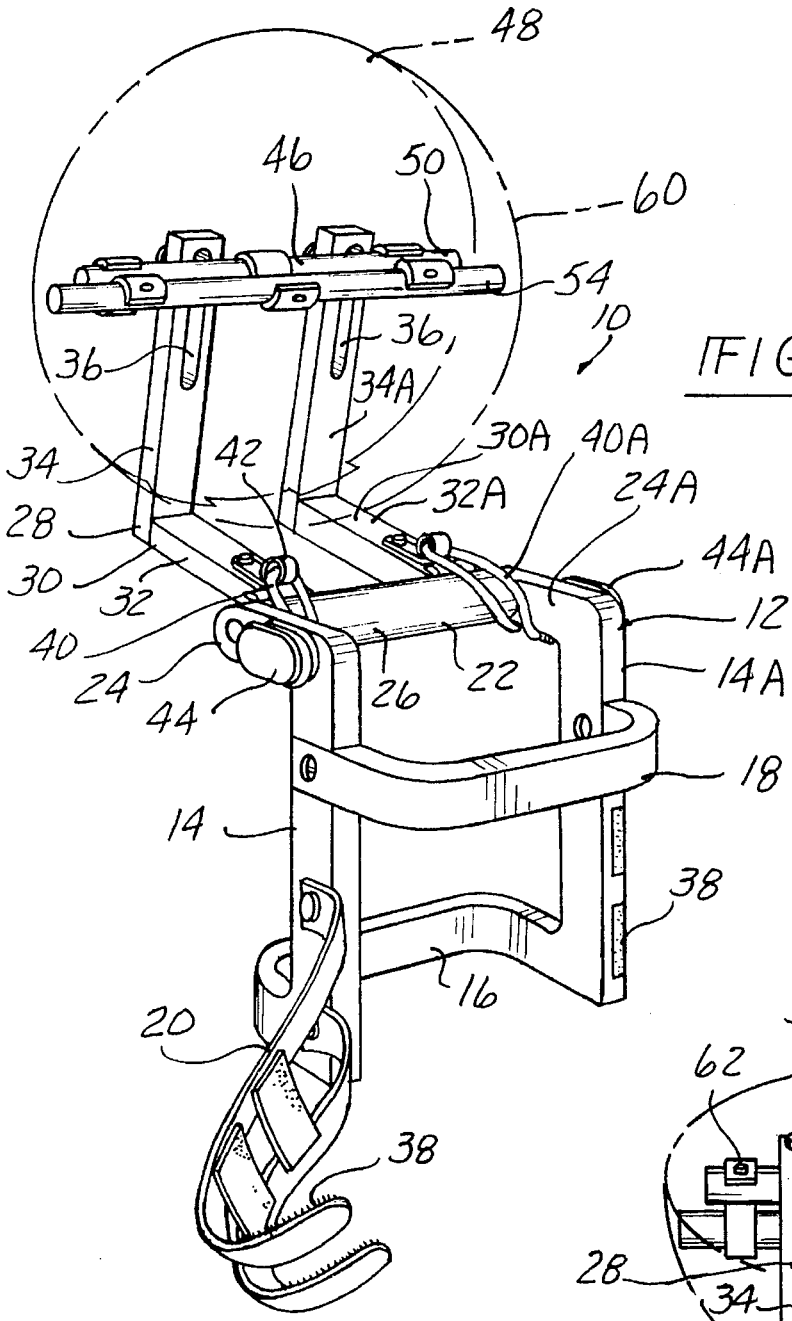
FIG. 1 is a perspective view of the basketball shot training device according to the teachings of the present invention, depicting the engagement element in phantom to more clearly show the details of the other components of the device.

Referring to FIG. 1, the basketball training device 10 according to the present invention includes a frame assembly including an elongated frame member 12, which is of an approximate length corresponding to the human forearm, i.e., roughly 12 inches in length. The frame member 12 is preferably in the form of two spaced apart longitudinally extending bars 14 and 14A connected along one end by a U-shaped cross bar 16 extending substantially perpendicular to the longitudinal bars 14 and 14A. A second U-shaped cross-bar 18 which extends in the direction opposite that of the first cross bar 16 is optionally, but preferably, provided to extend between the longitudinally extending bars 14 and 14A to provide a rigid forearm brace. Disposed along the other end of the elongate frame member 12 is a third substantially U-shaped cross bar 22 which includes a pair of bars 24 and 24A, extending perpendicularly from the longitudinal bars 14 and 14A, respectively, in the same direction as the first U-shaped cross bar 16. The cross bar 22 also includes a rotatable bar section 26 which serves to anchor the swingable resistance member 28.

The frame member 12 is also preferably equipped with one or more straps 20, which can be fastened around the forearm of the user, as with mating Velcro™ patches 38 provided on the outer end of each strap 20 and on the bars 14.

While the frame member 12 is illustrated as being formed from a rigid, metal stamping, it should be understood by those skilled in the art that frame member can be constructed of a variety of different structurally sound materials and further can be longitudinally adjustable as described in U.S. Pat. No. 5,271,617 which is hereby expressly incorporated by reference.

The resistance member 28 includes a pair of L-shaped legs 30 and 30A extending from the rotatable bar section 26 of the cross bar 22. In the fully retracted position, the first leg segments 32 and 32A, respectively, generally extend upwardly from the elongate frame and the second leg segments 34 and 34A, respectively, extend from the first leg segments rearwardly in the same direction as the second U-shaped cross bar 18. Provided along the second leg segments 34 and 34A are slots 36 which allow for adjustments to the position of the hand and finger engagement element 48 relative to the second leg segments to accommodate individuals of varying hand sizes.

At least one resilient member 40, and preferably a pair of resilient members 40 and 40A, are included which assist in providing a resistive force against the actuation of the resistance member 28 from a retracted to an extended position. The resilient members 40 and 40A, respectively, are generally in the form of elastic bands which are looped through retainers 42 fastened to the first segments of the L-shaped legs 30 and 30A and attached to protrusions 44 and 44A located on opposite sides of the frame along the outer surface of bars 24 and 24A, respectively. Ideally, the resilient members 40 and 40A will be adjustable to allow for increased or decreased tensioning of the resistance member 28 as desired.

Figure 3:
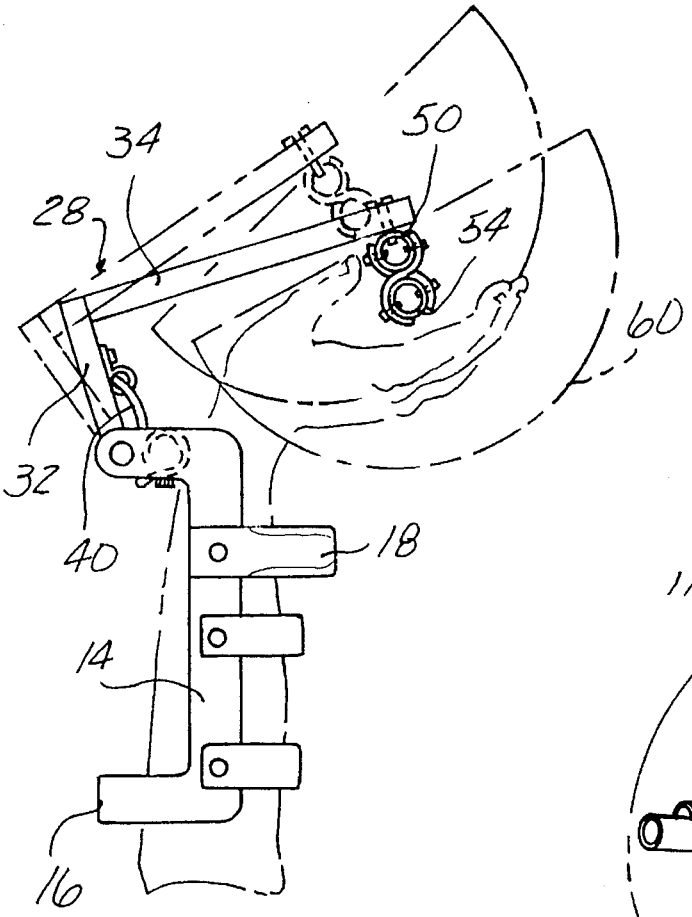
FIG. 3 is a side elevational view of the device shown in FIG. 1 illustrating the position of the user's hand while having the device attached to the forearm, depicting in phantom the execution of the training motion.

Extending at the distal end of the resistance member 28 between the second segments 34 and 34A of the L-shaped legs is a rotational assembly 46 which allows the hemispherical hand and finger engagement element 48 shown in phantom to partially rotate or oscillate as the resistance member 28 is actuated from a retracted position to an extended position and back to a retracted position. The surface of the engagement element 48, shaped as a portion of a regulation basketball, is sufficiently extensive to be simultaneously engaged by the naturally spread finger, thumb, and palm of one hand of the user, as shown in FIG. 3.

The rotational assembly 46 as illustrated most clearly in FIG. 5, generally includes a first carrier 50 adjustably attached to the second segments 34 and 34A of L-shaped legs through the use of a plurality of fasteners 52 and a second carrier 54 which is generally longer in length than the first carrier 50 which is fixedly attached along both ends to the inner diameter of the hand and finger engagement element 48. The rotational assembly 46 also includes means for generating a resilient resistance of the element 48 in one direction rotation in the form of a plurality of elastic straps 56 attached to both the first and second carriers 50 and 54, respectively, which are disposed in a stacked relationship. The straps 56 are attached to the stacked carriers such that each strap is wrapped in the opposite direction as that of the nearest strap as illustrated in FIGS. 3 and 5. The straps 56 can be attached to the carriers 50 and 54 by any suitable means such as mechanical fasteners including screws, bolts and the like shown at reference numeral 62 or through the use of adhesives, among others. Typically, the straps 56 are of a length which wrap around approximately half of each carrier, thus, the straps 56 appear to be S-shaped when viewed from the side. Preferably, the elastic straps 56 are sufficiently resilient to provide a resistance force or torque resisting the rotation of the engagement element 48 to assist in strengthening the various muscle groups involved in the shooting motion.

The finger and hand engagement element 48 which generally corresponds in size to the diameter of either a men's or women's regulation basketball is affixed such that the convex outer diameter surface 60, also shown in phantom, faces back toward the upper part of the elongate frame member. The hemispherical-shaped hand and finger engagement element 48 is thus affixed to the rotational assembly 46 such that the engagement element 48 can be partially rotated during the simulated shot motion.

To utilize the basketball shot training device 10, the user will position their forearm against the elongate frame member 12 such that their hand and fingers including the thumb engage the hemispheric outer surface 60 of the engagement element 40 to closely simulate the position of the arm, wrist, fingers and hand in the shooting position. Thereafter, the straps 20 are attached to the elongate frame to retain the device against the user's forearm.

Once the basketball shot training device 10 is attached to the user's forearm, by flexing the wrist, fingers and hand, the engagement element 48 is resistantly moved away from the retracted position to an extended position by swinging the resistance member forwardly. As previously noted, as the resistance member 28 swings forwardly, the rotational assembly 46 and, more precisely the second carrier 54, simultaneously rotates with resistance due to forces exerted on the engagement element by the hand and fingers, thereby more accurately simulating a preferred basketball shot motion in which back spin would be generated on the ball in an actual shot situation. Thus, the second carrier 54 becomes partially rotated while the first carrier 50 remains stationary.

This partial rotating motion of the engagement element 48 has been found to allow for movement of the hand and wrist which more accurately reflects the motion associated with execution of a basketball shot. The fingers and hand as well as the wrist and forearm of the user are thus exercised in an almost identical fashion to that involved in an execution of an actual shot.

The device also tends to cause the user to keep the elbow vertically aligned below the forearm during execution of the motion, which as mentioned above is helpful in making the shot. The device, therefore, assists in the development of proper shooting form.

Figure 4:
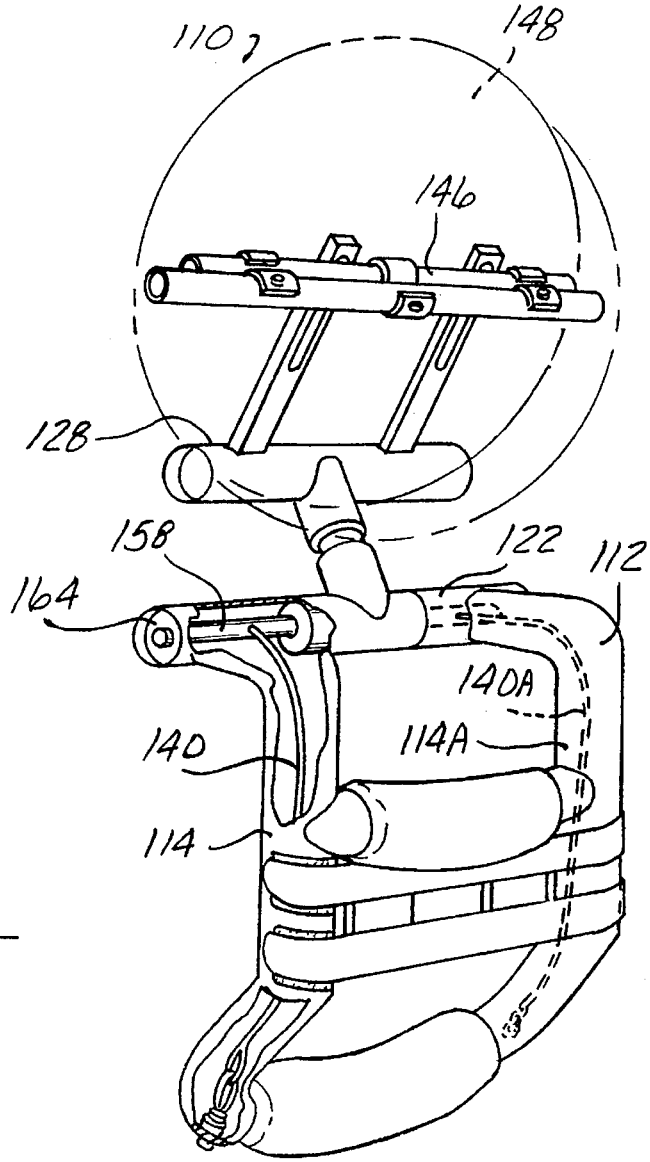
FIG. 4 is a reverse perspective view of an alternative basketball shot training device embodiment according to the teachings of the present invention, depicting the resilient means contained within the elongate frame member.

Referring to FIGS. 4 and 6, an alternative basketball shot training device embodiment in accordance with the teachings of the present invention is illustrated. The shot training device 110 of FIGS. 4 and 6 is operationally similar to the one illustrated with reference to FIGS. 1–3, however, the structure of the device has been varied somewhat to illustrate certain adaptations which should be considered within the scope of the accompanying claims. Where possible, like references numerals increased by 100 have been employed for like components.

The basketball shot training device 110 again includes as its major components an elongate frame member 112, a resistance member 128, resilient means 140, a finger and hand engagement element 148 and a rotational assembly 146. More precisely, the frame member 112 includes hollow longitudinal bars 114 and 114A within which the resilient means, in the form of flexible elastic bands 140 and 140A, are disposed. The frame 112 also includes a readily accessible hollow cross bar 122 which houses a rotatable spindle 158 to which the resilient means 140 shown as elastic bands are attached. While two elastic bands 140 and 140A, respectively, have been employed for illustrative purposes, it should be understood by those skilled in the art that a single elongated band which extends between both longitudinal bars and through the spindle could also be employed. Optionally, instead of the elastic bands, it is contemplated that resilient springs (not shown) could also be employed.

In the event that the user desires to access the spindle 158 and/or the elastic bands 140 and 140A, a selectively removable cap 164 is provided along at least one side of the cross bar 122, thus allowing for access. For example, after prolonged use of the shot training device 110, it may be desirable to substitute the elastic bands with stronger, less resilient bands to enhance the strength training aspect of the invention. By accessing the cross-bar 122, the resilient straps can be accessed.

With regard to the actuation of the resistance member 128, as the resistance member is pivotally rotated from a retracted position to an extended position by engagement of the finger and hand engagement element 148 and rotational assembly 146 as described above, the elastic bands are stretched with resistance as the spindle member 158 rotates as shown in FIG. 6. By returning the resistance member 128 to a retracted position, the spindle rotates back to the original position and the elastic bands become relaxed.

Figure 2:
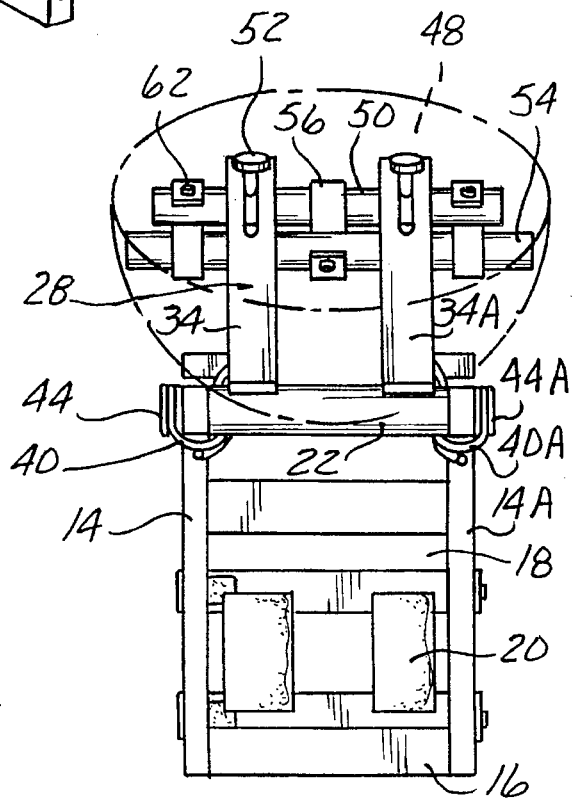
FIG. 2 is a reverse elevational view of the device shown in FIG. 1.

As with the basketball shot training device of FIGS. 1–3, the shot training device 110 serves to strengthen the muscles associated with developing a repetitious basketball shot as well as training the individual in the proper mechanics associated therewith.

Finally, referring to FIG. 7, an alternative rotational assembly 246 is illustrated. Under this embodiment, the rotational assembly 246 includes a carrier 250 attached to the legs 230 and 230A of the resistance member 228 via a plurality of fasteners 252. Again, the carrier 250 and ultimately, the finger and hand engagement element 248 can be adjusted along the second leg segments 234 and 234A to accommodate individuals of varying stature.

The rotational assembly 246 includes a resistance spring 256 attached at one end to the carrier 250 and extends to the inner surface of the finger and hand engagement element 248. Ideally, the resistance spring 256 is attached at the other end to the finger and hand engagement element near the top edge 260 located toward the side closest to the elongated frame member. Under this arrangement, the spring 256 is stretched as the engagement element 248 is rotated in one direction on the carrier 250, so that the rotational assembly 246 resists against free rotation similar to the assembly illustrated under FIGS. 1–6 to strengthen the involved muscle groups.

While specific constructions have been described in order to provide a description of specific embodiments in accordance with the requirements of 35 U.S.C. 112, it will, of course, be understood by those skilled in the art that a great variation in the construction of devices described herein are possible while still providing the same advantages and function thereof.

I claim:

1. A basketball shot training device comprising:

a frame assembly including an elongate frame member;

said frame assembly further including forearm securement means for detachably securing said elongate frame member to the forearm of an user;

an elongate resistance member having one end pivotally mounted to one end of said elongate frame member so as to be swingable between a retracted position and extended position;

resilient means for generating a resisting force on said resistance member as said resistance member is pivoted away from said retracted position;

a finger and hand engagement means including an element having a surface sufficiently extensive to be simultaneously engageable by the fingers, thumb, and palm of one hand of a user, means rotatably mounting said engagement means element on another end of said resistance member for oscillation upon pivotal actuation of said resistance member between said retracted and extended position with the fingers, thumb, and hand of a user in engagement with said surface of said element when the user's forearm is attached to said frame member;

means creating a resilient resistance torque acting against rotation of said engagement element in one direction, whereby resilient resistance to both the pushing of said resistance member and partial rotation of said engagement element is generated upon actuation of the resistance member against the force of said resilient means and rotation of said engagement element to provide resistance exercising of the wrist, forearm, fingers, thumb and hand as said resistance member is swung by the hand of the user between said retracted and extended positions.

2. The basketball shot training device of claim 1, wherein said means for rotatably mounting said finger and hand engagement element includes a carrier rod attached to said resistance member, said finger and hand engagement element rotationally supported on said carrier rod, and at least one resilient resistance element connected extending between said carrier rod and said finger and hand engagement element so as to resiliently resist rotation of said engagement element on said carrier rod while allowing said rotation, whereby upon rotation of said finger and hand engagement element a resistance is exerted on the fingers, thumb, and hand of the user.

3. The basketball shot training device of claim 1, wherein said resilient means includes at least one elongated flexible element extending along said elongated frame member enclosed within said frame assembly.

4. The basketball shot training device of claim 1, further including a rotary member fixed to said one end of said resistance member to rotate as said resistance member swings on said one end of said elongate frame member, a resiliently extensible elongate element having one end attached to said rotary member so as to be wrapped on said rotary member and pulled as said rotary member is rotated.

5. The basketball shot training device of claim 1, wherein the position of said finger and hand engagement element is selectively adjustable along the length of said resistance member.

6. The basketball shot training device of claim 1, wherein said elongate frame member includes a pair of longitudinally extending bars and at least one rigid cross bar connecting said longitudinally extending bars and which serves as a brace.

7. The basketball shot training device of claim 1, wherein said surface of said engagement element comprises a portion of a sphere substantially configured as a part of a basketball surface allowing said fingers and thumb of the user to be naturally spread when engaging said surface.

8. A basketball shot training device comprising:

an elongate frame member;

forearm securement means for detachably securing said elongate frame member to the forearm of an user;

a resistance member pivotally mounted to said elongate frame member so as to be swingable between a retracted position and extended position;

resilient means for generating a resilient force on said resistance member as said resistance member is pivoted away from said retracted position;

a finger and hand engagement element extending from said resistance member including a finger and hand engagement element upon pivotal actuation of said resistance member, said finger and hand engagement surface facing toward said elongate frame member and being engagable upon attachment of the frame member to the user's forearm to enable both the pushing and partial rotation of said engagement element and actuation of the resistance member against the force of said resilient means to provide resistance exercising of the wrist, forearm, fingers and hand as said resistance member is swung between said retracted and extended position;

said means for partial rotation of the finger and hand engagement element further comprising a rotational assembly including a first carrier adjustably attached to said resistance member and a second carrier member attached to said first carrier by a plurality of elastic straps, said second carrier member being attached to the finger and hand engagement element.

9. The basketball shot training device of claim 8, wherein said plurality of elastic straps include at least two straps, with a first strap wrapped around said first and second carriers in one direction and a second strap wrapped around said first and second carriers in a direction opposite that of said first strap.

10. The basketball shot training device of claim 9 wherein said plurality of straps are arranged such that each consecutive strap is wrapped around said first and second carriers in a direction opposite that of each adjacent strap.

11. The basketball shot training device of claim 8 wherein said plurality of elastic straps provide a resistance force against rotation of said finger and hand engagement element.

12. An improved basketball shot training device which is selectively attachable to an individual's forearm and includes a resistance member pivotally attached to an elongate frame member and a finger and hand engagement element extending from said resistance member, the improvement comprising:

means for partial rotation of said finger and hand engagement element whereby said finger and hand engagement element is at least partially rotatable while said resistance member is being actuated;

said means for partial rotation of the finger and hand engagement element further comprising of the finger and hand including a first carrier adjustably attached to said resistance member and a second carrier member attached to said first carrier by a plurality of elastic straps, said second carrier member being attached to the finger and hand engagement element.

13. The basketball shot training device of claim 12, wherein said plurality of elastic straps include at least two straps, with a first strap wrapped around said first and second carriers in one direction and a second strap wrapped around said first and second carriers in a direction opposite that of said first strap.

14. The basketball shot training device of claim 13, wherein said plurality of elastic straps are arranged such that each consecutive strap is wrapped around said first and second carriers in a direction opposite that of each adjacent strap.

15. The basketball shot training device of claim 12, wherein said plurality of elastic straps provide a resistance force against rotation of said finger and hand engagement element.

16. The basketball shot training device of claim 12, wherein said means for partial rotation of the finger and hand engagement element further comprises a rotational assembly including a carrier pivotally attached to said resistance member and at least one resilient spring extending between said carrier and said finger and hand engagement element, whereby upon rotation of said finger and hand engagement element said at least one resilient spring resists rotation.

17. A basketball shot training device, comprising:

an elongate frame member including first and second spaced apart longitudinal bars connected by a plurality of U-shaped cross bars;

forearm securement means for detachably securing said elongate frame member to the forearm of an user;

a resistance member pivotally mounted to one end of said elongate member so as to be swingable between a retracted position and an extended position;

resilient means for generating a resilient force on said resistance member as said resistance member is pivoted away from said retracted position, said resilient means including at least one elastic band extending between said resistance member and said elongate frame member;

said at least one elastic band contained within said elongate frame member;

a finger and hand engagement element extending from said resistance member including a finger and hand engagement surface facing toward said elongate frame and being engagable upon attachment of the frame member to the user's forearm; and means for allowing resistive partial rotation of said finger and hand engagement element upon actuation of said resistance member.

18. The basketball shot training device of claim 17, wherein said means for allowing resistive partial rotation of said finger and hand engagement element include a pair of carriers, a first carrier attached to said resistance member, a second carrier attached to said engagement element, a plurality of elastic straps, with a first strap wrapped around said first and second carriers in one direction and a second strap wrapped around said first and second carriers in a direction opposite that of said first strap.

19. The basketball shot training device of claim 18, wherein said plurality of elastic straps are arranged such that each consecutive strap is wrapped around said first and second carriers in a direction opposite that of each adjacent strap.

20. The basketball shot training device of claim 18 wherein said means for allowing resistive partial rotation further comprises a carrier pivotally attached to said resistance member and at least one resilient spring extending between said carrier and said finger and hand engagement element.

21. The basketball shot training device of claim 17, wherein the position of said finger and hand engagement element is selectively adjustable along said resistance member to accommodate users of various stature.

22. The basketball shot training device of claim 17 wherein said elongate frame member includes at least one rigid cross bar which serves as a brace.

23. The basketball shot training device of claim 17, wherein said elongate frame member is selectively adjustable to accommodate individuals of various stature.

* * * * *